US009329566B2

(12) United States Patent
Kimura et al.

(10) Patent No.: US 9,329,566 B2
(45) Date of Patent: May 3, 2016

(54) CONFIGURATION OF AN IMAGE FORMING DEVICE FOR ACCESSING AN IMAGE FORMING UNIT

(71) Applicant: Brother Kogyo Kabushiki Kaisha, Nagoya-shi, Aichi-ken (JP)

(72) Inventors: Shinji Kimura, Kani (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/494,932

(22) Filed: Sep. 24, 2014

(65) Prior Publication Data

US 2015/0010324 A1 Jan. 8, 2015

Related U.S. Application Data

(63) Continuation of application No. 13/747,975, filed on Jan. 23, 2013, now Pat. No. 8,886,086, which is a continuation of application No. 13/274,273, filed on Oct. 14, 2011, now Pat. No. 8,401,427, which is a (Continued)

(30) Foreign Application Priority Data

Apr. 11, 2005 (JP) ..... 2005-113104

(51) Int. Cl.
*G03G 21/18* (2006.01)
*G03G 21/16* (2006.01)

(52) U.S. Cl.
CPC ..... *G03G 21/1661* (2013.01); *G03G 21/1619* (2013.01); *G03G 21/1633* (2013.01);

(Continued)

(58) Field of Classification Search
CPC ..... G03G 21/1853; G03G 21/1633; G03G 2221/1684; G03G 2221/1846; G03G 2221/1853; G03G 2221/1869; G03G 2221/1884; G03G 15/0178; G03G 2215/0119
USPC ..... 399/112, 113
See application file for complete search history.

(56) References Cited

U.S. PATENT DOCUMENTS 2,730,423 A 1/1956 Mock
5,182,595 A 1/1993 Fukuchi et al.

(Continued)

FOREIGN PATENT DOCUMENTS

JP 04-116668 A 4/1992
JP 04-121757 A 4/1992

(Continued)

*Primary Examiner* — David Gray
*Assistant Examiner* — Andrew V Do
(74) *Attorney, Agent, or Firm* — Banner & Witcoff, Ltd.

(57) ABSTRACT

An image forming device including a casing having a front wall formed with a first opening and an upper wall continuous to the front wall and formed with a second opening. The first and second openings together form a single opening. The device further includes a door for covering the single opening, a belt unit, and a guide member. The belt unit includes first and second rollers, and a conveyer belt. The drawer is configured to accommodate a plurality of cartridges. The guide member is configured to movably guide the drawer. The first roller is disposed nearer to the single opening than the second roller to the single opening. In a state where the door is opened and the drawer is inside the casing, one of the plurality of cartridges closest to the door is detachably attachable to the drawer through the single opening.

4 Claims, 12 Drawing Sheets

Related U.S. Application Data continuation of application No. 13/105,076, filed on May 11, 2011, now Pat. No. 8,064,794, which is a continuation of application No. 12/781,568, filed on May 17, 2010, now Pat. No. 7,962,062, which is a continuation of application No. 11/401,295, filed on Apr. 11, 2006, now Pat. No. 7,747,190.

(52) U.S. Cl.
CPC ..... *G03G21/1647* (2013.01); *G03G 21/1853* (2013.01); *G03G 2215/1685* (2013.01); *G03G 2221/1684* (2013.01); *G03G 2221/1869* (2013.01)

(56) References Cited

U.S. PATENT DOCUMENTS

| | | | | |
|---|---|---|---|---|
| 5,210,573 | A | 5/1993 | Fukuchi et al. | |
| 5,298,946 | A | 3/1994 | Haneda et al. | |
| 6,366,749 | B1 * | 4/2002 | Koumoto ..... | G03G 21/1821 399/111 |
| 6,535,704 | B1 | 3/2003 | Hoyt, III et al. | |
| 6,708,011 | B2 | 3/2004 | Nomura et al. | |
| 6,898,407 | B2 | 5/2005 | Noguchi et al. | |
| 6,973,283 | B2 | 12/2005 | Sato et al. | |
| 7,778,567 | B2 | 8/2010 | Igarashi et al. | |
| 2002/0135655 | A1 | 9/2002 | Ameyama et al. | |
| 2004/0136747 | A1 | 7/2004 | Tanizaki et al. | |
| 2005/0019064 | A1 | 1/2005 | Sato et al. | |
| 2005/0169653 | A1 | 8/2005 | Noguchi et al. | |
| 2006/0067732 | A1 | 3/2006 | Igarashi | |
| 2006/0140668 | A1 | 6/2006 | Sato et al. | |
| 2006/0140669 | A1 | 6/2006 | Sato | |
| 2006/0140673 | A1 * | 6/2006 | Kamimura et al. ..... | 399/119 |

FOREIGN PATENT DOCUMENTS

| | | | |
|---|---|---|---|
| JP | 04-121758 | A | 4/1992 |
| JP | 04-157476 | A | 5/1992 |
| JP | 04-159533 | A | 6/1992 |
| JP | 04-184360 | A | 7/1992 |
| JP | 05-044370 | A | 2/1993 |
| JP | 05-045940 | A | 2/1993 |
| JP | 05-173396 | A | 7/1993 |
| JP | 05-257340 | A | 8/1993 |
| JP | 10-186775 | A | 7/1998 |
| JP | 11-095520 | A | 4/1999 |
| JP | 2002-091123 | A | 3/2002 |
| JP | 2002-268321 | A | 9/2002 |
| JP | 2003-015378 | A | 1/2003 |
| JP | 2003-076106 | A | 3/2003 |
| JP | 2003-107838 | A | 4/2003 |
| JP | 2003-202728 | A | 7/2003 |

* cited by examiner

CONFIGURATION OF AN IMAGE FORMING DEVICE FOR ACCESSING AN IMAGE FORMING UNIT

CROSS REFERENCE TO RELATED APPLICATION

This application is a continuation of co-pending U.S. patent application Ser. No. 13/747,975 filed Jan. 23, 2013, which is a continuation of U.S. application Ser. No. 13/274,273 filed Oct. 14, 2011, now U.S. Pat. No. 8,401,427 issued Mar. 19, 2013, which is a continuation of U.S. application Ser. No. 13/105,076 filed May 11, 2011, now U.S. Pat. No. 8,064,794 issued Nov. 22, 2011, which is a continuation of U.S. application Ser. No. 12/781,568 filed May 17, 2010, now U.S. Pat. No. 7,962,062, issued Jun. 14, 2011, which is a continuation of Ser. No. 11/401,295, filed Apr. 11, 2006, which is now U.S. Pat. No. 7,747,190, issued Jun. 29, 2010, which claims priority from Japanese Patent Application No. 2005-113104 filed Apr. 11, 2005, the entire content of which is incorporated herein by reference.

TECHNICAL FIELD

The disclosure relates to an electrographic image forming device such as a laser printer.

BACKGROUND

U.S. Pat. Nos. 5,182,595 and 5,210,573 disclose a laser printer having a main body and a cartridge. A plurality of image forming units are provided within the cartridge. The cartridge is drawn out from the main body so that a user can execute an inspection and maintenance of the image forming units and replacement of parts in the image forming units.

SUMMARY

It is conceivable that operations such as inspection of the image forming units are executed in the state where the cartridge is drawn out from the main body to the maximum so that the plurality of image forming units are exposed outside. However, when the cartridge is drawn out from the main body by a large amount, the cartridge largely projects outwards. Moreover, the center of gravity of the overall device moves towards the drawing side, allowing the device to be easily tilted. Thus, it will be difficult to perform operations such as inspection and replacement.

In view of the foregoing, it is an object of the invention to provide an image forming device capable of improving operability in making operations such as inspection, maintenance and replacement of image forming units.

In order to attain the above and other objects, the invention provides an image forming device of electronic photography including a casing, a door, a belt unit, a drawer, and a guide member. The a casing includes a front wall formed with a first opening, and an upper wall continuous to the front wall and formed with a second opening. The first opening and the second opening together forms a single opening. The door is configured to cover the single opening. The belt unit is disposed in the casing and includes a first roller, a second roller, and a conveyer belt stretched over the first roller and the second roller. The drawer is coupled to the casing and is configured to accommodate a plurality of cartridges. The guide member is disposed in the casing and is configured to movably guide the drawer. The first roller is disposed nearer to the single opening of the casing than the second roller to the single opening. In a state where the door is opened and the drawer is inside the casing, one of the plurality of cartridges closest to the door is detachably attachable to the drawer through the single opening.

BRIEF DESCRIPTION OF THE DRAWINGS

In the drawings:

FIGS. 2(A) and 2(B) are schematic sectional views of a guide groove when viewed from the side of an opening, wherein FIG. 2(A) is a schematic sectional view of the guide groove in a state where an engaging member is located at a release position and FIG. 2(B) is a schematic sectional view of the guide groove in a state where the engaging member is located at an engagement position;

DETAILED DESCRIPTION

Figure 1:
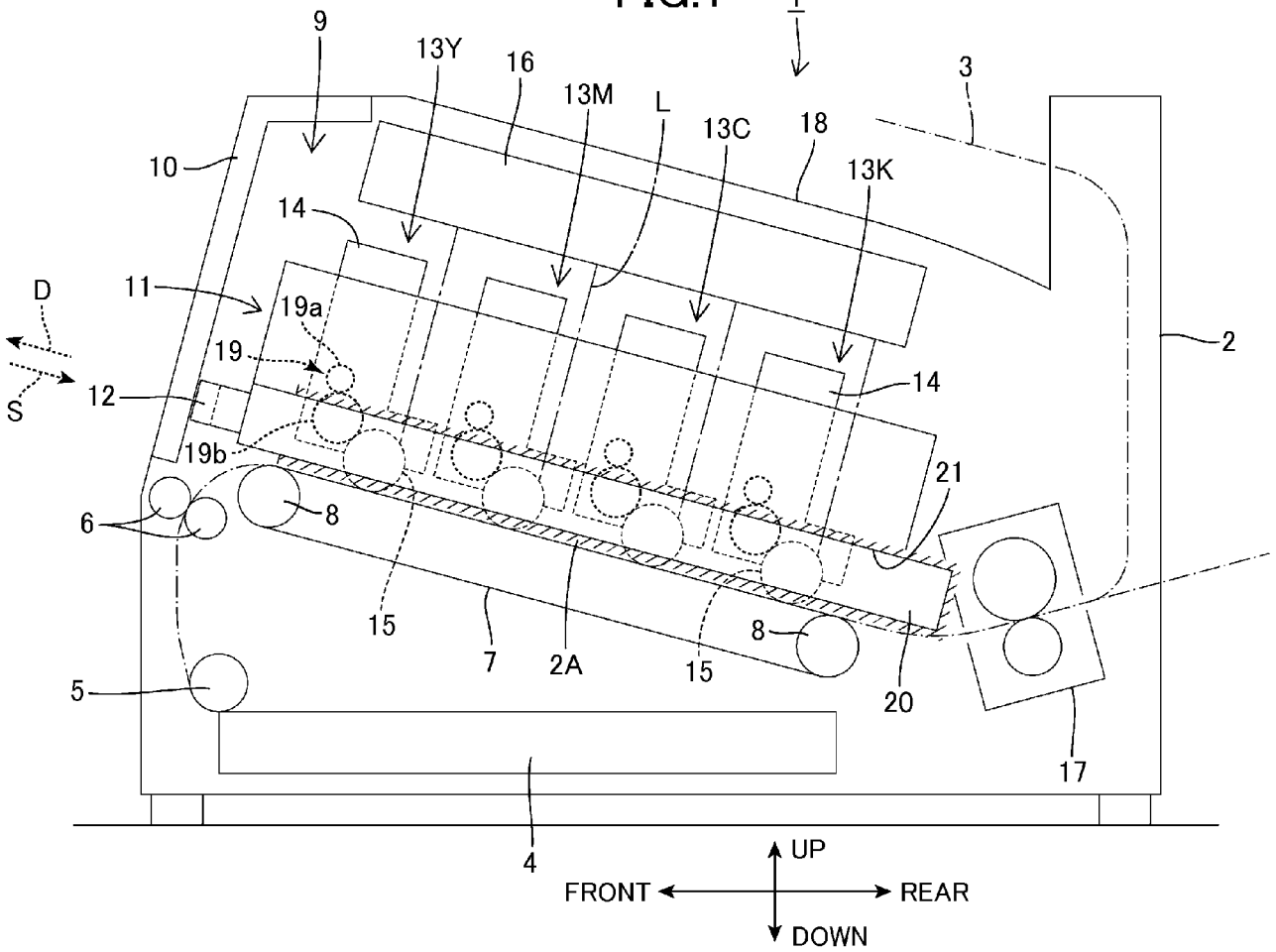
FIG. 1 is a schematic side sectional view showing the state where a drawer is located at a storage position in a laser printer in accordance with a first embodiment of the invention.

An image forming device according to embodiments of the invention will be described while referring to the accompanying drawings wherein like parts and components are designated by the same reference numerals to avoid duplicating description.

<First Embodiment>

A tandem-type color laser printer according to a first embodiment will be described with reference to FIGS. 1 to 10.

(Overall Configuration of the Laser Printer)

FIG. 1 is a schematic side sectional view of the laser printer 1.

The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1.

The laser printer 1 has a main body casing 2. A sheet feed cassette 4 is provided on the bottom of the main body casing 2 and can be drawn out of the main body casing 2 forward in the horizontal direction. Sheets of paper or other kinds of sheet material can be mounted in the sheet feed cassette 4. A paper feed roller 5 is mounted in the main body casing 2 at a front upper end of the sheet feed cassette 4. Sheets 3 mounted on the sheet feed cassette 4 are sent upwards one at a time by the paper feed roller 5 from the sheet feed cassette 4 along a conveyance path that is represented by a chain line in FIG. 1.

A pair of conveyance rollers 6 are provided above the sheet feed roller 5. The sheet 3 is conveyed by the rollers 6 to a conveying belt 7. The conveying belt 7 is located at the rear of the conveyance rollers 6. The conveying belt 7 is of an endless shape and is stretched on a pair of support rollers 8 and 8. The conveying belt 7 is inclined upwardly toward the front end along a predetermined drawing direction D which will be described later. The conveying belt 7 is for conveying the sheet 3 on its top face in a rearward direction.

The main body casing 2 is formed with an opening 9. The opening 9 is formed over a region extending from the upper portion of the front surface of the main body casing 2 to the front end of the upper surface of the main body casing 2. A cover 10 is mounted on the main body casing 2 to cover the opening 9. The cover 10 is openable and closable.

The main body casing 2 accommodates a drawer 11 therein. As shown in FIG. 1, the drawer 11 can be stored within the main body casing 2 at a storage position above the conveying belt 7. A user can open the cover 10, and pull the drawer 11 from the storage position in a direction parallel to the top face of the conveying belt 7, that is, in the drawing direction D. Thus, the user can draw the drawer 11 obliquely upwardly toward the front. As a result, the drawer 11 is drawn out of the main body casing 2 through the opening 9. After the drawer 11 is drawn out of the main body casing 2, the user can press the drawer 11 in a storing direction S that is opposite to the drawing direction D. Thus, the drawer 11 can return back to the storage position in the main body casing 2.

The drawer 11 is of an elongated box shape, whose top and bottom faces are partially opened. The drawer 11 is kept in an orientation, in which the drawer 11 is inclined upwardly toward the front, with its bottom face being parallel to the top face of the conveying belt 7. A handle 12 is provided on the front face of the drawer 11. A user grips the handle 12 to draw the drawer 11 from the main body casing 2.

The drawer 11 is oriented with its elongated direction being along the drawing direction D. the drawer 11 holds therein four process cartridges 13Y, 13M, 13C and 13K that are aligned in the longitudinal direction, that is, in the drawing direction D. The process cartridges 13Y, 13M, 13C and 13K correspond to yellow, magenta, cyan and black, respectively. Each process cartridge 13: has a toner case 14 for storing a toner therein; a photosensitive drum 15 for carrying an electrostatic latent image; and a developing device 19 for developing the electrostatic latent image into a visible toner image. The developing device 19 includes: a supply roller 19*a* for supplying toner from the toner case 14 to a developing roller 19*b;* and the developing roller 19*b* for developing the electrostatic latent image carried on the photosensitive drum 15 into a visible toner image. Each process cartridge 13 is mounted in the drawer 11, with its photosensitive drum 15 being exposed through the opening section of the bottom face of the drawer 11 and facing the top face of the conveying belt 7. Each process cartridge 13 can be detached from the drawer 11 by lifting up the process cartridge 13 through the opening section of the top face of the drawer 11.

A scanner 16 is mounted in the main body casing 2 at a location above the drawer 11. The scanner 16 irradiates each photosensitive drum 15 with a laser light L corresponding to image data of a corresponding color to form a corresponding electrostatic latent image on the surface of the photosensitive drum 15. The developing device 19 develops the electrostatic latent image into a visible toner image by using toner. The toner images carried on the photosensitive drums 15 are sequentially transferred onto a sheet of paper 3 as being superposed one on another, while the sheet of paper 3 is being conveyed on the top face of the conveying belt 7. As a result, a full-color image is formed on the sheet of paper 3.

A sheet of paper 3, on which a full-color image has been formed as described above, is then conveyed to a fixing part 17, which is mounted in the main body casing 2 at the rear of the conveying belt 7. The fixing part 17 thermally fixes the full-color image onto the sheet 3. After having passed through the fixing part 17, the sheet 3 is discharged out of the main body casing 2. The sheet 3 may be discharged to the rear of the main body casing 2 or on a sheet output tray 18 that is provided on the top face of the main body casing 2.

(Engagement Structure of Drawer)

The main body casing 2 has a pair of side walls (right-side wall and left-side wall) 2A that are disposed on the right-side and left-side of the main body casing 2, respectively. When the drawer 11 is mounted in the laser printer 1, the drawer 11 is located between the pair of opposite side walls 2A in the widthwise direction (right-to-left direction) of the laser printer 1.

Figure 2A:
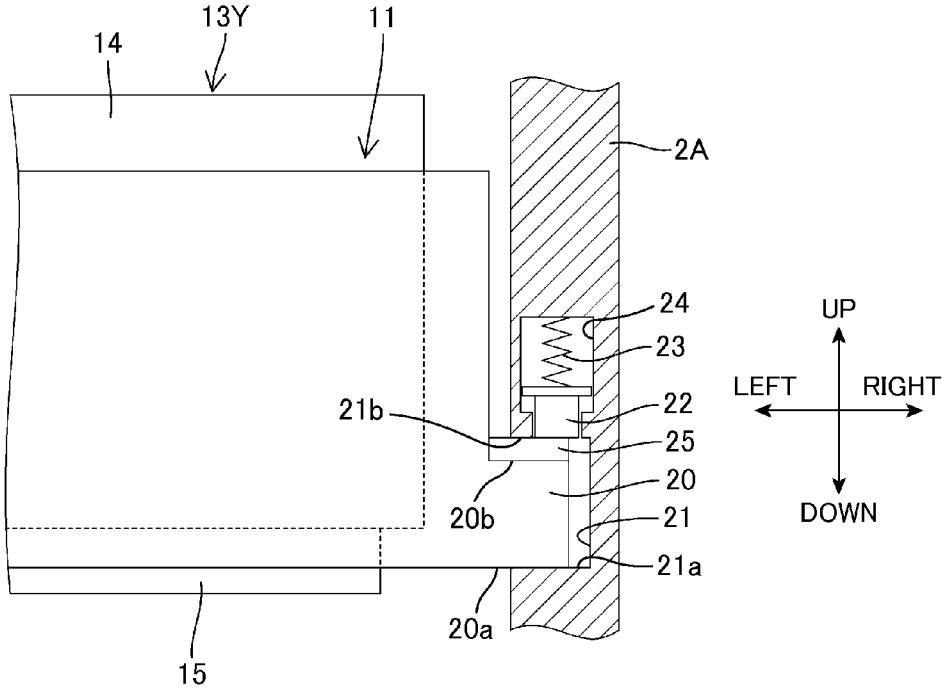
Figure 2B:
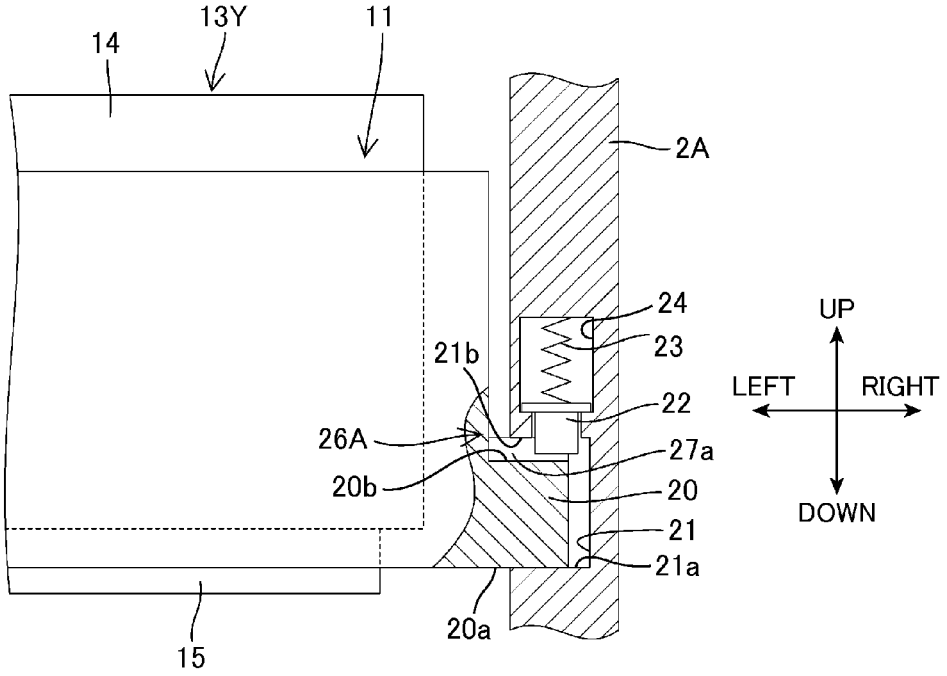

FIGS. 2(A) and 2(B) are schematic sectional views of a right-side end portion of the drawer 11 and a right-side wall 2A viewed from the side of the opening 9, that is, from the front side.

A pair of guide protrusions (right-side and left-side guide protrusions) 20 are formed on the lower ends of the right- and left-side surfaces of the drawer 11. The guide protrusions 20 protrude outwardly in the widthwise direction from the drawer 11. That is, the right-side guide protrusion 20 protrudes rightwardly from the drawer 11, while the left-side guide protrusion 20 protrudes leftwardly from the drawer 11. The right-side guide protrusion 20 is shown in FIGS. 2(A) and 2(B). Each guide protrusion 20 is elongated along the longitudinal direction of the drawer 11, that is, along the drawing direction D of the drawer 11. Each guide protrusion 20 has a bottom surface 20*a* and a top surface 20*b*, both of which extend in the drawing direction D.

Figure 3:
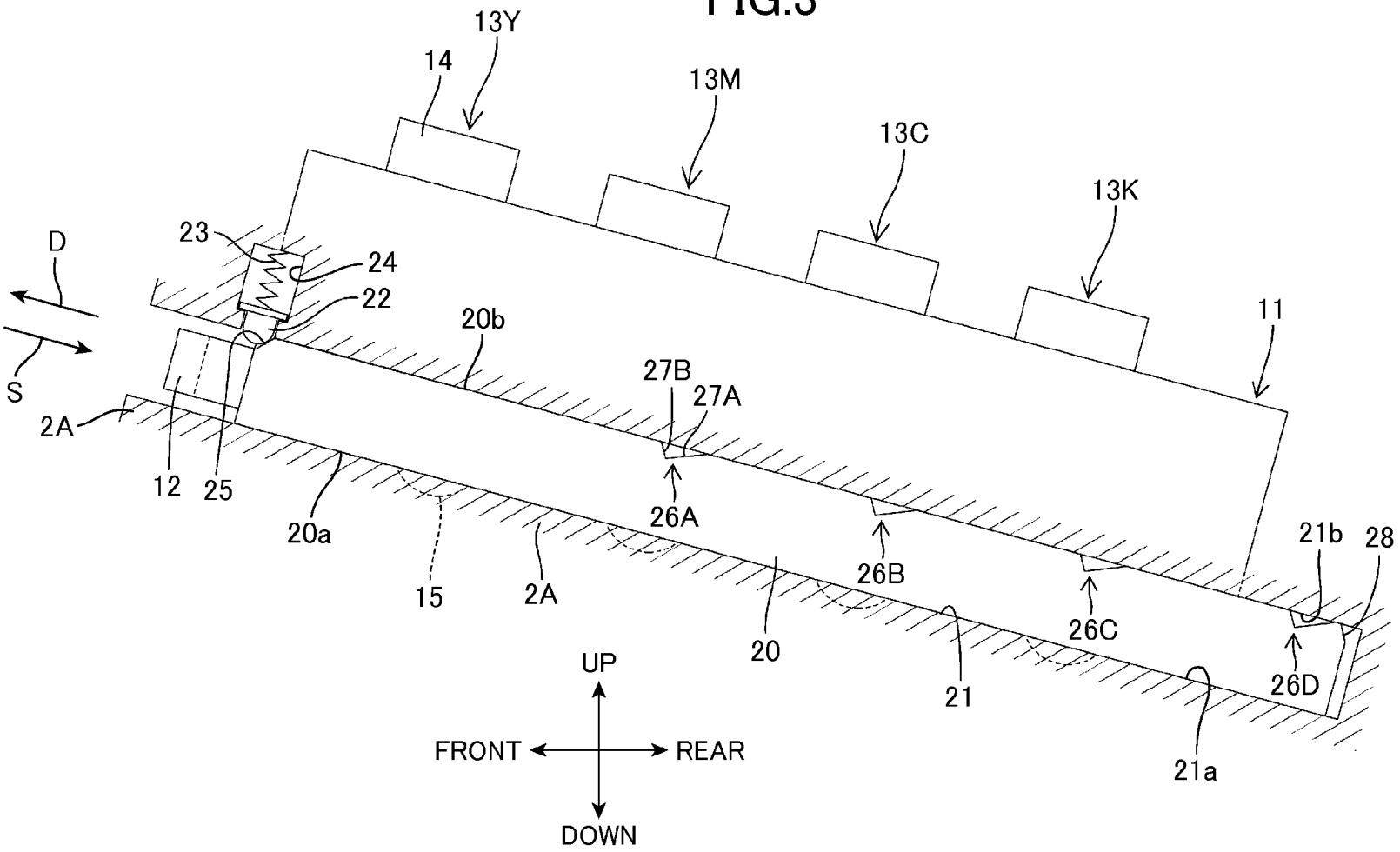
FIG. 3 is a schematic side sectional view of the drawer and guide groove in a state where the drawer is located at a storage position.

A guide groove 21 is formed on the inner side surface of each side wall 2A. That is, a guide groove 21 is formed on the left-side surface of the right-side wall 2A, and another guide groove 21 is formed on the right-side surface of the left-side wall 2A. The guide groove 21 formed on the right-side wall 2A is shown in FIGS. 2(A) and 2(B). The guide groove 21 extends parallel with the stretching direction of the conveying belt 7. In other words, the guide groove 21 extends in the drawing direction D. FIG. 3 is a schematic side sectional view showing the guide groove 21 formed on the right-side wall 2A. The guide groove 21 has a floor surface 21*a* and a ceiling surface 21*b*, both of which extend in the drawing direction D.

The guide protrusion 20 protruding from the right-side of the drawer 11 is fitted into the guide groove 21 on the right-side wall 2A, while the guide protrusion 20 protruding from the left-side of the drawer 11 is fitted into the guide groove 21 formed on the left-side wall 2A. The drawer 11 can move backward and forward along the guide grooves 21, with the guide protrusions 20 moving along the guide grooves 21. That is, the top surface 20*b* of each guide protrusion 20 slides against the ceiling surface 21*b* of the corresponding guide groove 21, while the bottom surface 20*a* of each guide protrusion 20 slides against the floor surface 21*a* of the corresponding guide groove 21. Thus, the drawer 11 is guided along the guide grooves 21 on the right- and left-side walls 2A. The drawer 11 can be drawn out from the main body casing 2 and can be pressed into the main body casing 2.

Each side wall 2A is further formed with a bore 24. The bore 24 is located in the vicinity of the front end of the side wall 2A, near to the opening 9. The bore 24 is elongated in a direction perpendicular to the drawing direction D. In other words, the bore 24 has a longitudinal axis that extends perpendicularly to the drawing direction D. The bore 24 is opened through the ceiling surface 21*b* of the guide groove 21 and is in fluid communication with the guide groove 21. Thus, the bore 24 is connected to the guide groove 21 at the vicinity of the front end of the guide groove 21.

An engaging member 22 is mounted inside the bore 24. The engaging member 22 is movable along the longitudinal axis of the bore 24. Thus, the engaging member 22 is capable of moving or displacing in the direction perpendicular to the guide groove 21. As shown in FIG. 3, a tip end of the engaging member 22 is formed in the shape of a substantially semicircular arc when viewed from the side. The engaging member 22 can move between an engagement position where its tip end protrudes in the guide groove 21 as shown in FIG. 2(B) and a release position where the tip end retracts from the guide groove 21 as shown in FIG. 2(A).

A coil spring 23 is also mounted in the bore 24 to urge the engaging member 22 along the longitudinal axis of the bore 24 in a direction toward the floor surface 21*a* of the guide groove 21. In other words, the engaging member 22 is urged by the coil spring 23 in a direction from the release position toward the engagement position.

A front-end inclined surface 25 is formed at a front end of the top surface 20*b* of the guide protrusion 20. The front-end inclined surface 25 slopes downwardly to the front. When the drawer 11 is located at the storage position shown in FIG. 3, the engaging member 22 located at the engagement position engages with the front-end inclined surface 25.

Four engagement recesses 26A to 26D are formed on the top surface 20*b* of the guide protrusion 20. The engagement recesses 26A to 26D are aligned at a regular interval along the drawing direction D on the top surface 20*b* of the guide protrusion 20. The engaging member 22 can engage with each of the engagement recesses 26A to 26D.

Figure 4:
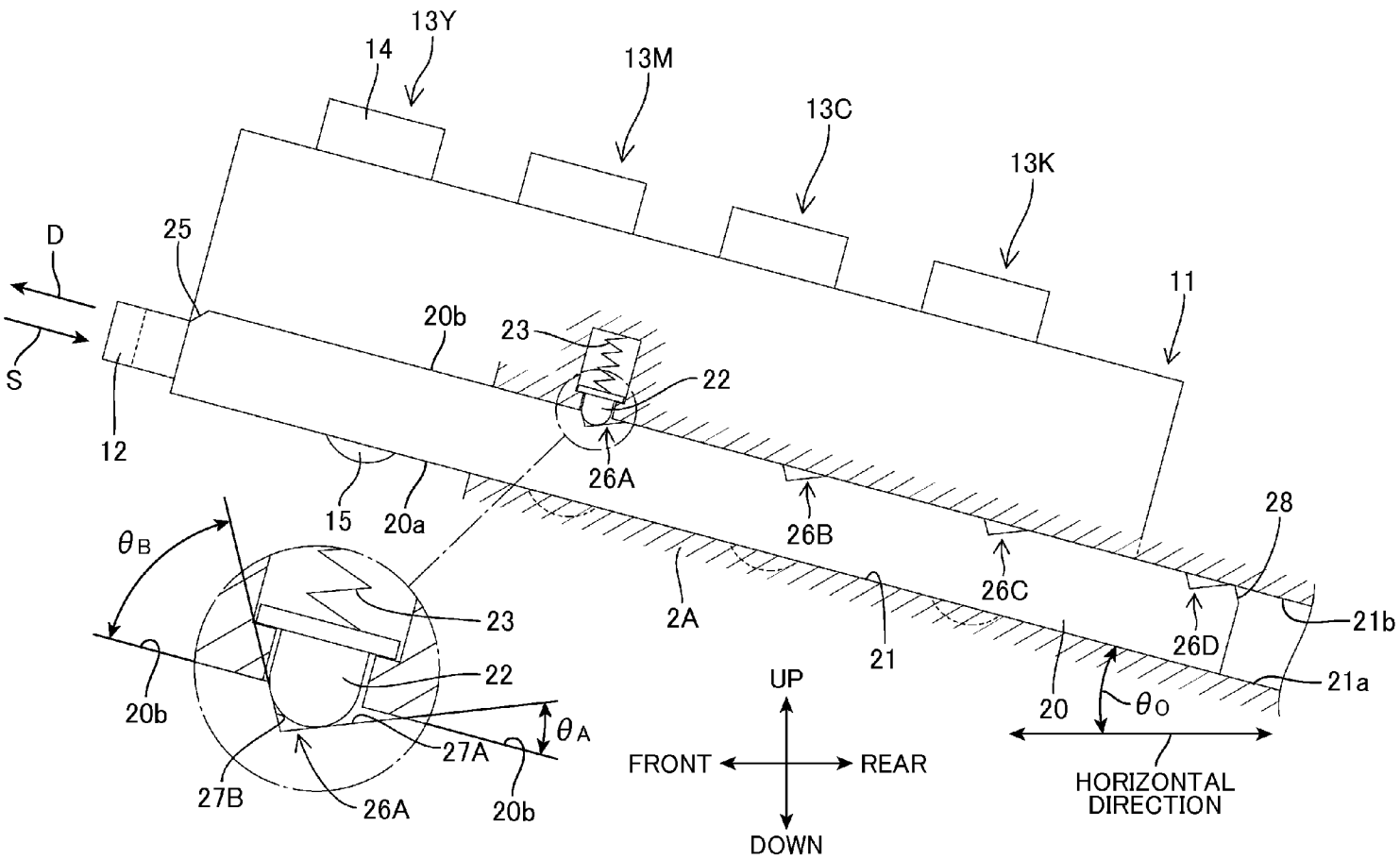
FIG. 4 is a schematic side sectional view of the drawer and guide groove in a state where the drawer is located at a first drawing position.
Figure 5:
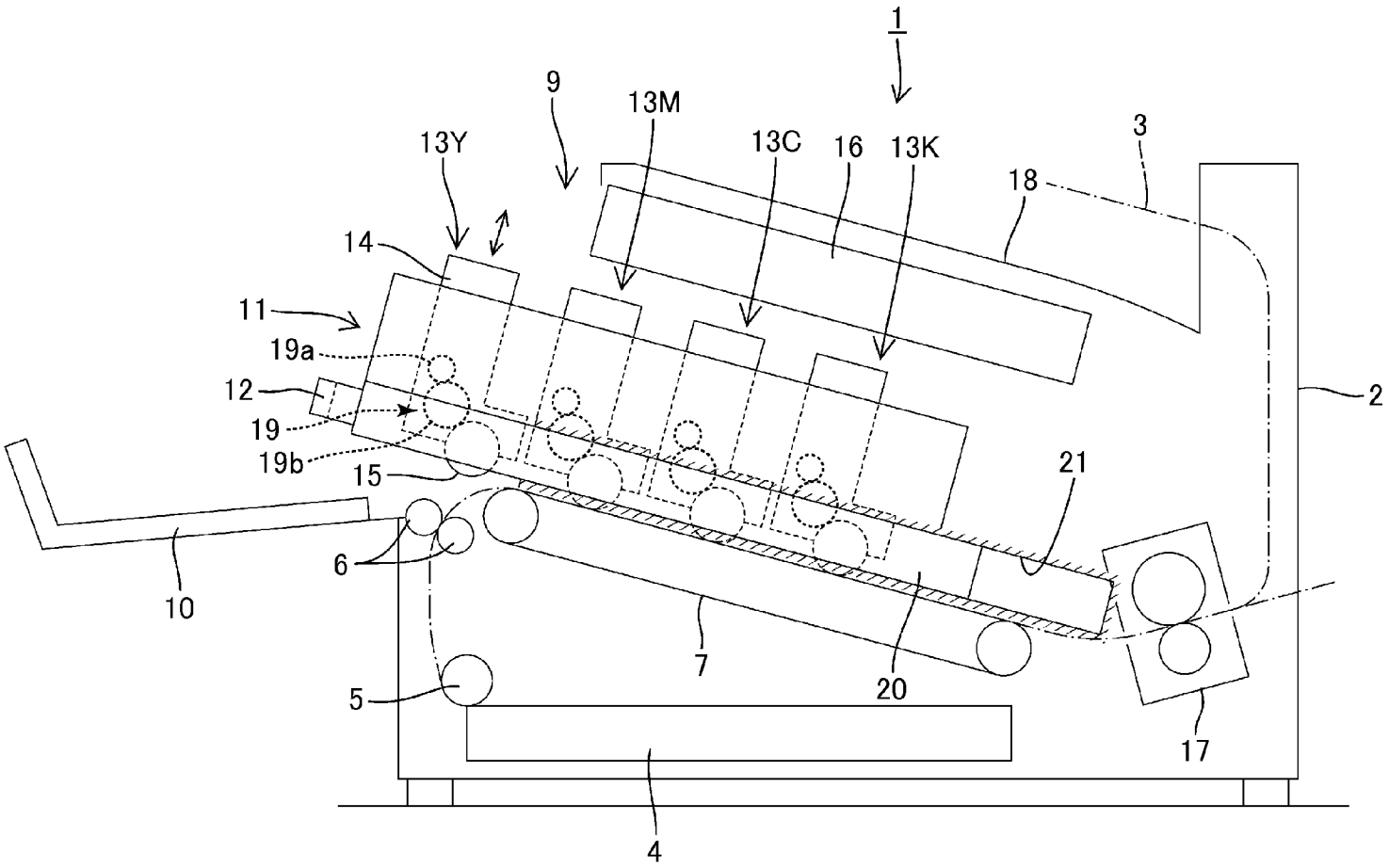
FIG. 5 is a schematic side sectional view of the laser printer in the state where the drawer is located at the first drawing position.
Figure 6:
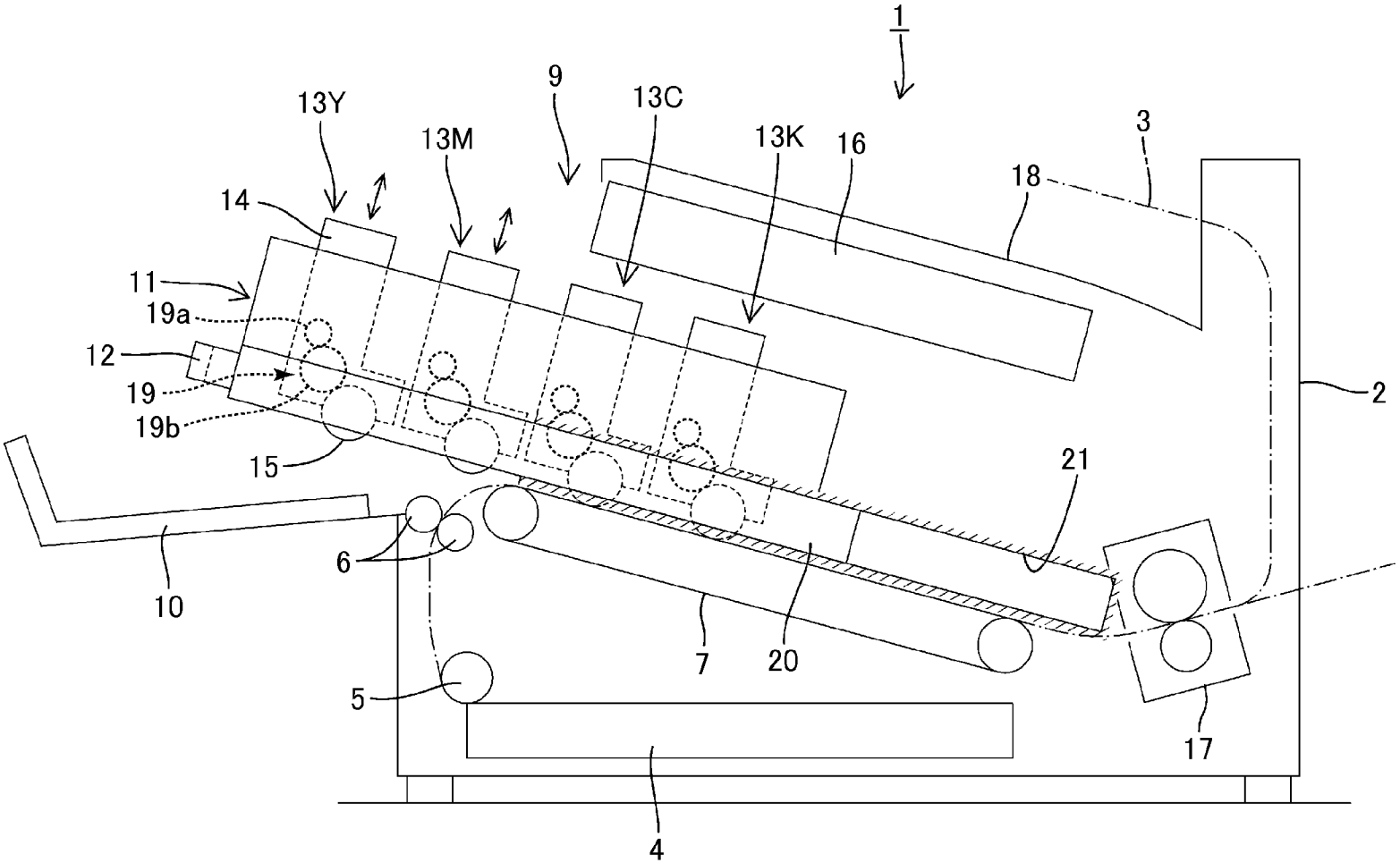
FIG. 6 is a schematic side sectional view of the laser printer in a state where the drawer is located at a second drawing position.
Figure 7:
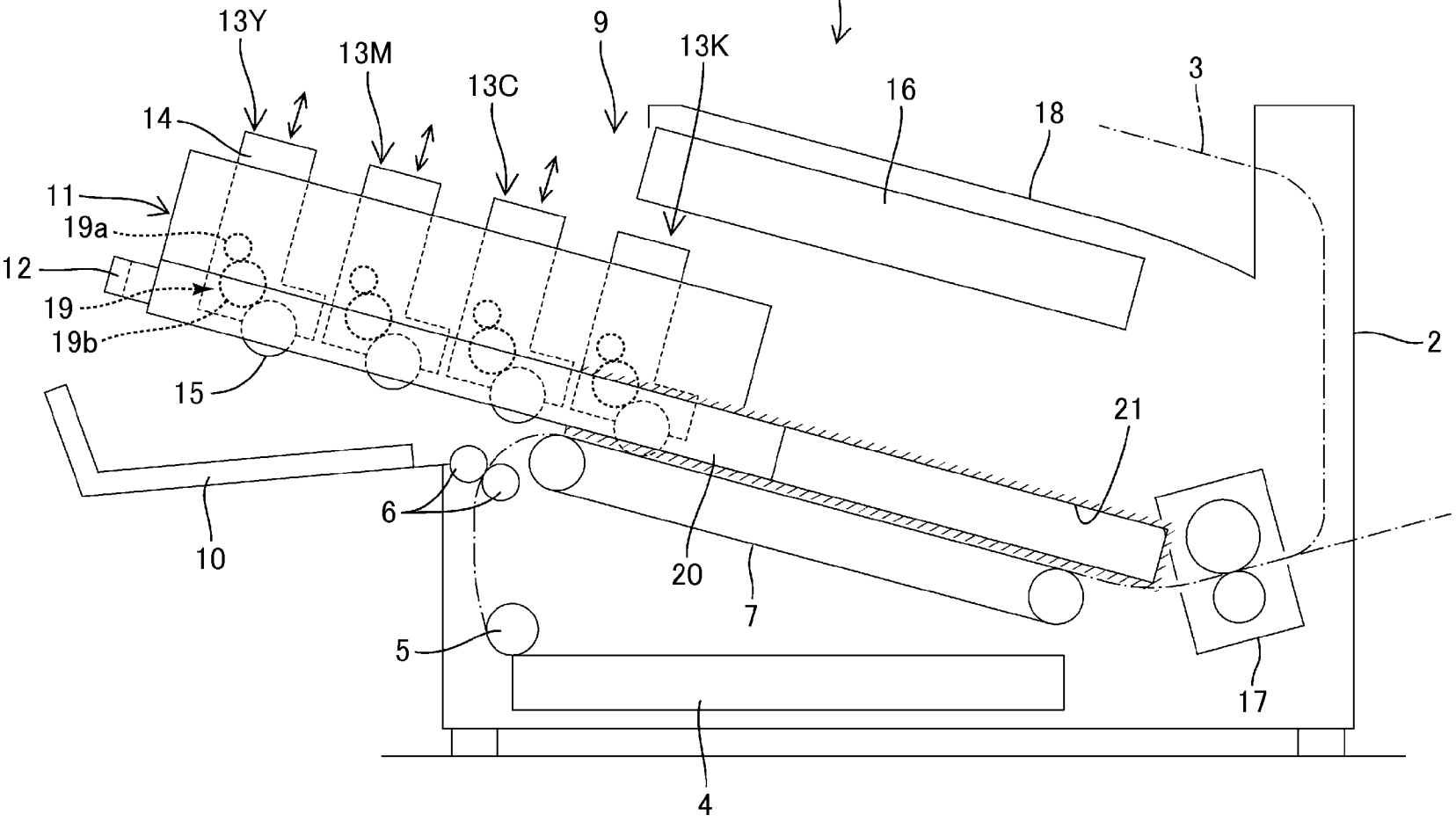
FIG. 7 is a schematic side sectional view of the laser printer in a state where the drawer is located at a third drawing position.

Each of the engagement recesses 26A to 26D is substantially of a v-shaped cross-section viewed from the side. Each engagement recess 26A, 26B, 26C, or 26D has: a rear-side inclined surface 27A which slopes downwardly toward the front; and a front-side inclined surface 27B which slopes upwardly toward the front from the front end of the rear-side inclined surface 27A. As shown in FIG. 4, an angle θB of greater than zero degree is defined between the front-side inclined surface 27B and the top surface 20*b*, and an angle θA of greater than zero degree is defined between the rear-side inclined surface 27A and the top surface 20*b*.

Now assume that an engaging force of an amount F1 is exerted from the coil spring 23 to the engaging member 22 when the engaging member 22 is in the engagement position and is engaged with each engagement recess 26A, 26B, 26C, or 26D. Further assume that the slope of the floor surface 21*a* relative to the horizontal direction (an angle defined between the floor surface 21*a* and the horizontal) is θ0 (greater than zero degree), that the total weight of the drawer 11 and all the process cartridges 13Y-13K is m, and that the gravitational acceleration is g. According to the present embodiment, the values F1, θB, θ0, m, and g satisfy the following inequality (1):

$$F1 \geq \{mg(\sin \theta 0)\}/(\tan \theta B) \quad (1)$$

Accordingly, when the engaging member 22 is in engagement with each engagement recess 26A, 26B, 26C, or 26D, it is ensured that the engagement between the engaging member 22 and the engagement recess 26A, 26B, 26C, or 26D can prevent the drawer 11 from returning back to the storage position due to the weight of the drawer 11 and the process cartridges 13Y-13K. In other words, it is ensured that the drawer 11 will not slide along the floor surface 20*a* downwardly to the rear, even if there is no friction between the bottom surface 20*a* of the guide protrusion 20 and the floor surface 21*a* of the guide groove 21.

More specifically, if the values F1, θB, θ0, m, and g fail to satisfy the above inequality (1) and if there is no friction between the bottom surface 20*a* and the floor surface 21*a*, even when the engaging member 22 is engaged with one of the engagement recesses 26A-26D, the drawer 11 will slide along the floor surface 21*a* of the guide groove 21 downwardly to the rear due to the weight of the drawer 11 and the process cartridges 13Y-13K, while allowing the engaging member 22 to slide along the front-side inclined surface 27B upwardly to the front and to be disengaged from the engagement recess 26A, 26B, 26C, or 26D.

Additionally, according to the present embodiment, the angle θA formed between the rear-side inclined surface 27A and the top surface 20*b* is smaller than the angle θB formed between the front-side inclined surface 27B and the top surface 20*b*. In other words, the slope of the rear-side inclined surface 27A relative to the top surface 20*b* is smaller than the slope of the front-side inclined surface 27B relative to the top surface 20*b*.

In the state where the engaging member 22 is in engagement with one of the engagement recesses 26A to 26D, when the user presses or pushes the drawer 11 in the storing direction S, the engagement between the engaging member 22 and the engagement recess 26A, 26B, 26C, or 26D exhibits a first type of engaging force against the user's action of pushing the drawer 11 in the storing direction S. Similarly, in the state where the engaging member 22 is in engagement with one of the engagement recesses 26A to 26D, when the user pulls or draws the drawer 11 in the drawing direction D, the engagement between the engaging member 22 and the engagement recess 26A, 26B, 26C, or 26D exhibits a second type of engaging force against the user's action of drawing the drawer 11 in the drawing direction D. Because the angle θA is smaller than the angle θB, the amount of the second type of engaging force against the user's drawing action is smaller than the amount of the first type of engaging force against the user's pushing action.

A rear-end inclined surface 28 is formed at a rear end of the top surface 20*b* of the guide protrusion 20. The rear-end inclined surface 28 slopes downwards toward the rear. As described later, the rear-end inclined surface 28 guides the engaging member 22 when the rear end of the guide protrusion 20 is fitted into the front end of the guide groove 21.

Figure 8:
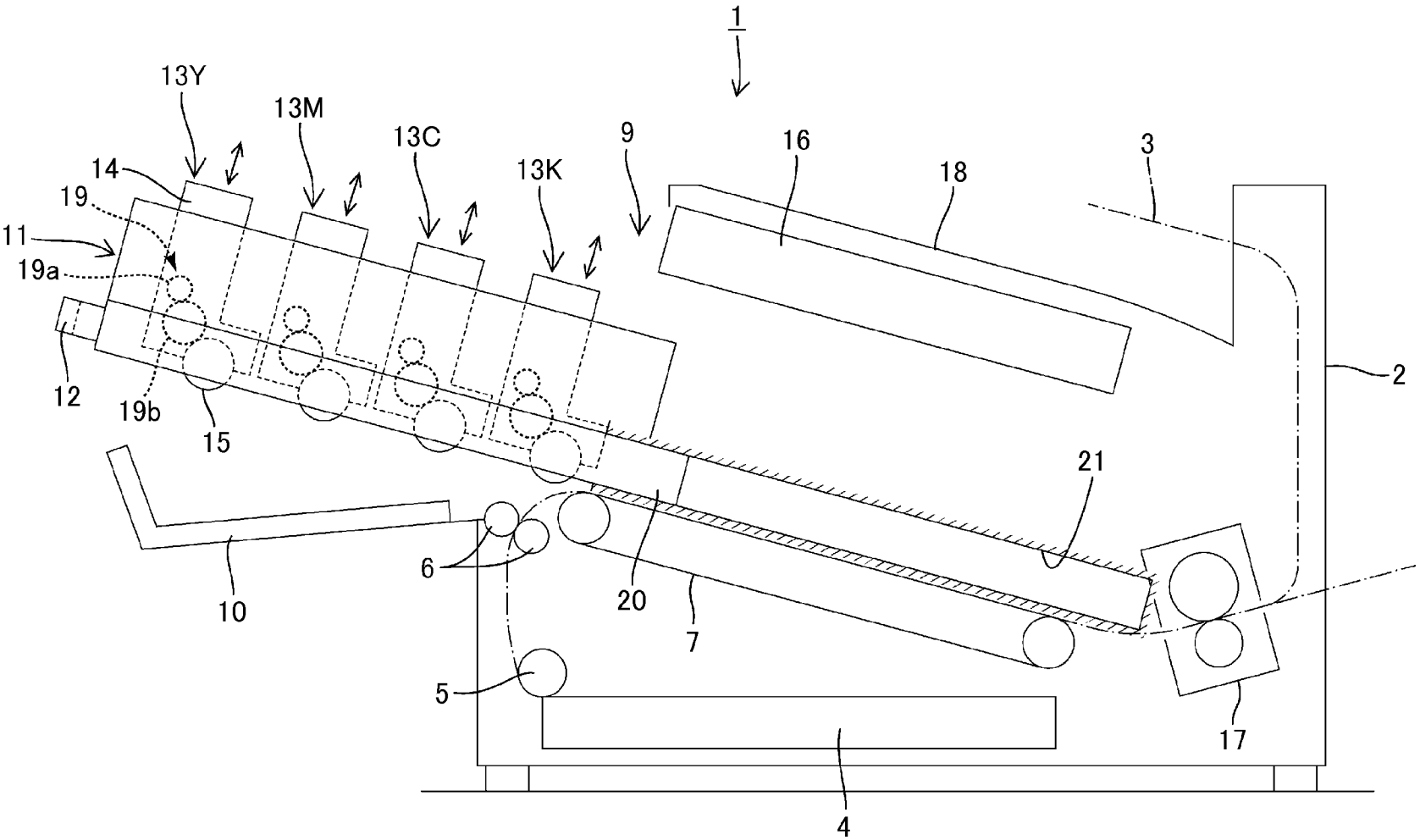
FIG. 8 is a schematic side sectional view of the laser printer in a state where the drawer is located at a fourth drawing position.
Figure 9:
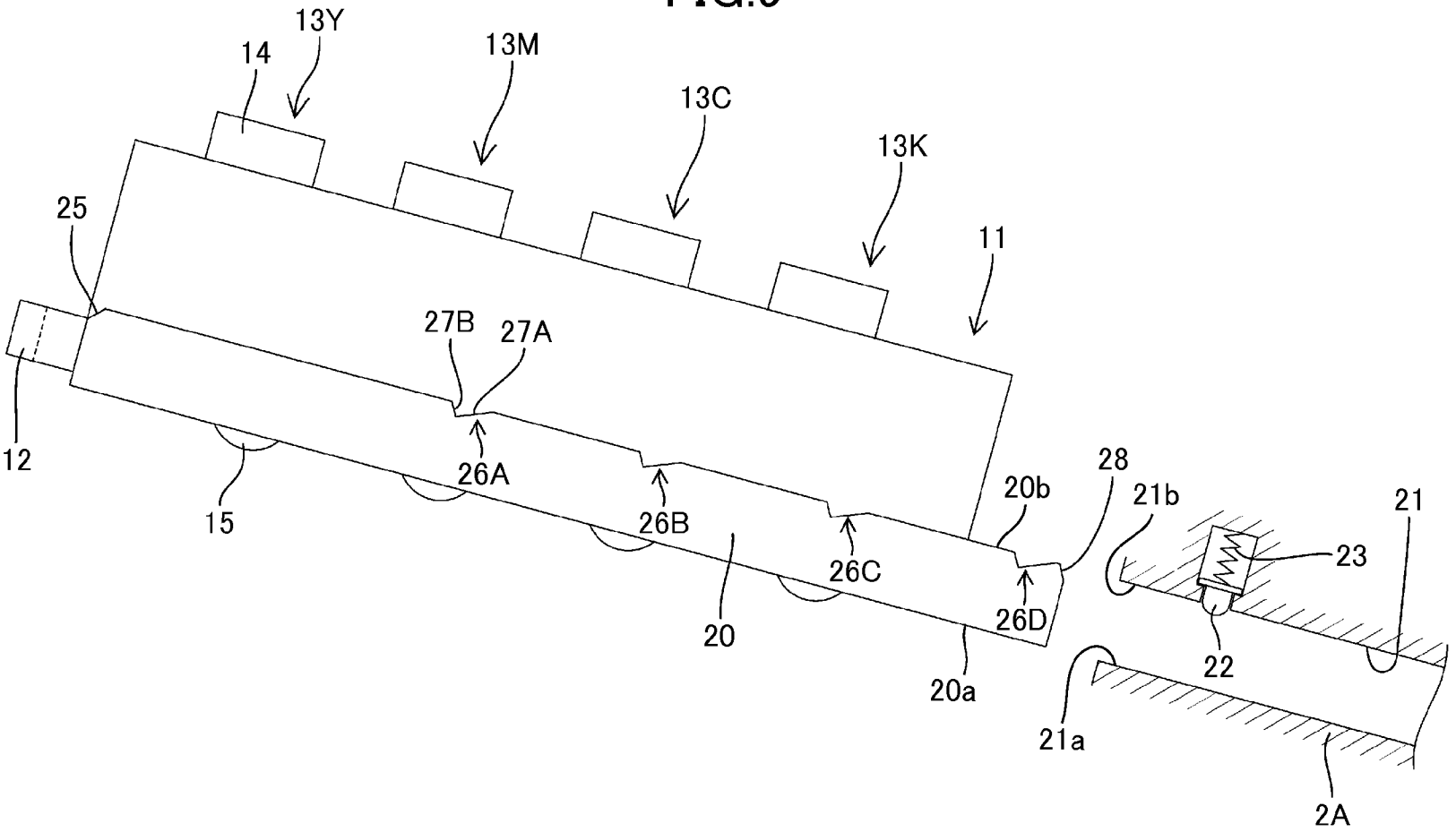
FIG. 9 is a schematic side sectional view of the drawer and guide groove in a state where the drawer is detached.

FIGS. 3, 4 and 9 show the positional relationship between the drawer 11 and guide groove 21 in distinct positions. FIGS. 5 to 8 and 10 show how the position of the drawer 11 is successively varied.

In order to draw the drawer 11 out of the main body casing 2 from the storage position shown in FIGS. 1 and 3, first, the user opens the cover 10 and then grips the handle 12 and pulls the drawer 11 forward in the drawing direction D. As a result, the engaging member 22 that is originally engaged with the front-end inclined surface 25 as shown in FIG. 3 is guided by the front-end inclined surface 25, moves to the release position while compressing the coil spring 23 and finally runs onto the top surface 20*b* of the guide protrusion 20 as shown in FIG. 2(A).

Subsequently, when the engaging member 22 arrives at the foremost engagement recess 26A, the coil spring 23 is restored to the original state, and the engaging member 22 is displaced from the release position to the engagement position and engages with the engagement recess 26A at its tip end as shown in FIGS. 2(B) and 4. The engaging force of the engaging member 22 against the engagement recess 26A is sufficiently large that prevents the drawer 11 from returning back to the storage position due to the total weight of the drawer 11 and all the process cartridges 13Y-13K. Accordingly, when the engaging member 22 reaches the engagement recess 26A, if the user stops his/her drawing operation, the drawer 11 will be held at a first drawing position shown in FIG. 5 without returning to the storage position. At the first drawing position, the foremost process cartridge 13Y is exposed to the outside. The user can inspect and perform maintaining operation on the process cartridge 13Y as well as detach the process cartridge 13Y from the drawer 11. On the contrary, since the other process cartridges 13M, 13C and 13K are still located within the main body casing 2, not exposed, inspection and maintenance of the cartridge 13M, 13C or 13K cannot be made.

When the drawer 11 is further drawn from the first drawing position, the engaging member 22 is guided by the rear-side inclined surface 27A of the engagement recess 26A and is displaced from the engagement position to the release position. Subsequently, when the engaging member 22 arrives at the engagement recess 26B located at the second position and engaged therewith, the drawer 11 is engaged at a second drawing position shown in FIG. 6. At the second drawing position, since the front two process cartridges 13Y and 13M are exposed to the outside, inspection and maintenance of these cartridges can be carried out.

Similarly, when the drawer 11 is further drawn out from the second drawing position, the engaging member 22 disengages from the engagement recess 26B. When the engaging member 22 engages with the engagement recess 26C located at the third position, the drawer 11 is held at a third drawing position shown in FIG. 7. At the third drawing position, since the front three process cartridges 13Y, 13M and 13C are exposed to the outside, inspection and maintenance of these cartridges can be carried out.

When the drawer 11 is further drawn out from the third drawing position, the engaging member 22 disengages from the engagement recess 26C. When the engaging member 22 engages with the engagement recess 26D located at the fourth position, the drawer 11 is held at a fourth drawing position shown in FIG. 8. At the fourth drawing position, all of the process cartridges 13Y to 13K are exposed to the outside, and therefore inspection and maintenance of all of these cartridges can be performed.

Thus, by drawing out the drawer 11 in this manner, the drawer 11 sequentially reaches the first through fourth drawing positions, while moving in the drawing direction D. While the drawer 11 sequentially reaches the first through fourth drawing positions, the process cartridges 13Y to 13K are sequentially exposed to the outside. Each time the drawer 11 reaches one of the first through fourth drawing positions, the drawer 11 is engaged at the subject drawing position. Thus, by drawing out the drawer 11 to the position where one or more process cartridges 13Y to 13K desired to be inspected are exposed and engaging the drawer 11 at the position, the drawing amount can be minimized.

In order to return the drawer 11 from each of the first through fourth drawing positions back to the storage position, the user presses the drawer 11 in the storing direction S toward the storage position. As a result, the engaging member 22 that is now in engagement with the corresponding engagement recess 26A, 26B, 26C, or 26D is shifted to the release position along the front-side inclined surface 27B so as to release the engagement from the engagement recess 26A, 26B, 26C, or 26D. The drawer 11 moves in the storing direction S as being pressed by the user. Even when the engaging member 22 engages with another engagement recess 26B, 26C, or 26D while the drawer 11 is moving in the storing direction S, the engagement is released again when the user continues his/her pressing operation. Therefore, the drawer 11 can successfully reach the storage position of FIGS. 1 and 3.

Figure 10:
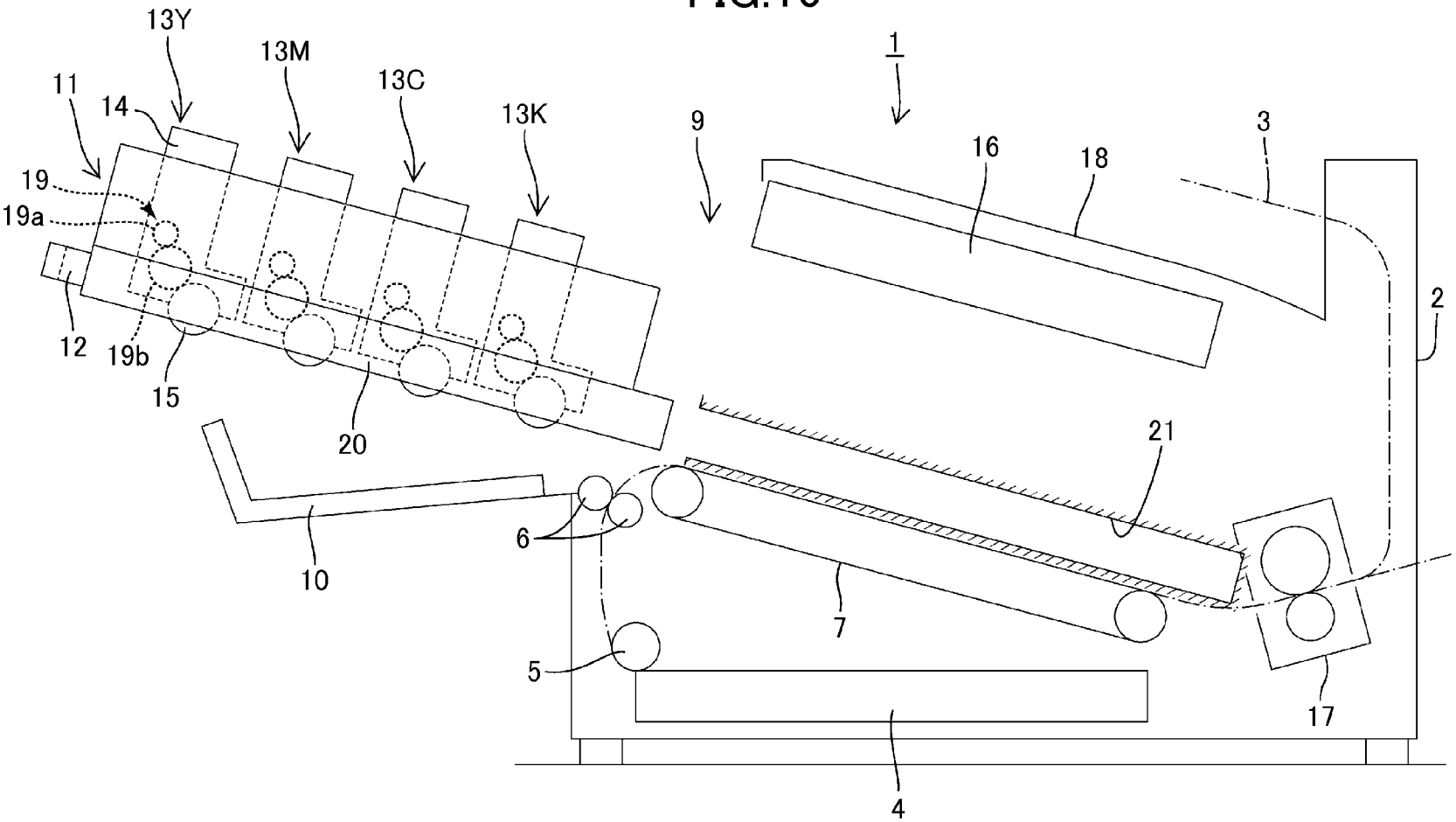
FIG. 10 is a schematic side sectional view of the laser printer in the state where the drawer is detached.

In order to completely detach the drawer 11 from the main body casing 2, the user draws the drawer 11 further forwards from the fourth drawing position shown in FIG. 8. As a result, the guide protrusion 20 is separated from the guide groove 21 as shown in FIGS. 9 and 10. The drawer 11 is completely detached from the main body casing 2. In this state, the user can cope with a sheet jam within the main body casing 2.

To attach the detached drawer 11 back to the main body casing 2, the user fits the guide protrusion 20 into the guide groove 21. It is noted that when the drawer 11 is in the detached state, the engaging member 22 protrudes inside the guide groove 21 as shown in FIG. 9. When the user fits the rear end of the guide protrusion 20 into the front end of the guide groove 21, the engaging member 22 is guided by the rear-end inclined surface 28 to retract from the guide groove 21 to the release position. Accordingly, the guide protrusion 20 can be smoothly fitted into the guide groove 21. Then, the user presses the drawer 11 in the storing direction S into the main body casing 2.

As described above, in this embodiment, when desiring to perform inspection and maintenance as well as replacement of desired one or more process cartridge 13Y to 13K, the drawer 11 is drawn to the drawing position where the desired one or more process cartridge 13Y to 13K is exposed, and the drawer 11 is held at the drawing position by the engagement between the engaging member 22 and the corresponding engagement recess 26A to 26D. Accordingly, the drawing amount can be minimized. Thus, the protruding amount of the drawer 11 can be controlled. Moreover, the laser printer 1 can be stabilized due to reduction in lateral movement of the center of gravity thereof. Operability is improved.

When desiring to replace some toner case 14 with a new one, the drawer 11 is drawn to the drawing position where at least a process cartridge 13Y, 13M, 13C, or 13K that has the desired toner case 14 is exposed, and the drawer 11 is engaged to the main body casing 2 at the subject drawing position. Thus, the drawing amount can be minimized and operability can be improved.

Engagement and disengagement of the engaging member 22 to and from the engagement recess 26A, 26B, 26C, or 26D is executed in association with the drawing operation of the drawer 11. Operability is more excellent compared to the case where an additional operation were required to engage and disengage the engaging member 22 to and from the engagement recess 26A, 26B, 26C, or 26D separately from the drawing operation of the drawer 11.

The plurality of engagement recesses 26A to 26D are aligned in the drawing direction D on the guide protrusion 20. The engaging member 22 can be displaced between the engagement position and release position. The engaging member 22 is urged by the coil spring 23 from the release position toward the engagement position. The combination of the engagement recesses 26A to 26D and the engaging member 22 has a simple configuration.

Engagement of the engaging member 22 with the front-end inclined surface 25 of the guide protrusion 20 can prevent the drawer 11 from being improperly drawn out of the storage position. Since the engaging member 22 properly holds the drawer 11 at the storage position, the configuration of the entire device 1 can be simplified.

Since the drawer 11 is drawn out diagonally upwards relative to the main body casing 2, lateral movement of the center of gravity is reduced, compared to the case where the drawer 11 is drawn out in the horizontal direction. This further stabilizes the overall device 1.

Moreover, the engaging force of the engaging member 22 against the engagement recesses 26A to 26D is sufficiently large that can prevent the drawer 11 from returning to the storage position due to the weight of the drawer 11 and the process cartridges 13Y-13K. Accordingly, when the drawer 11 is at the drawing position, the drawer 11 is prevented from returning to the storage position due to the weight of the drawer 11 and process cartridges 13.

<Second Embodiment>

Next, referring to FIGS. 11 and 12, a second embodiment of the invention will be described.

A laser printer 30 according to the second embodiment is the same as the laser printer 1 according to the first embodiment except for the points described below.

Figure 11:
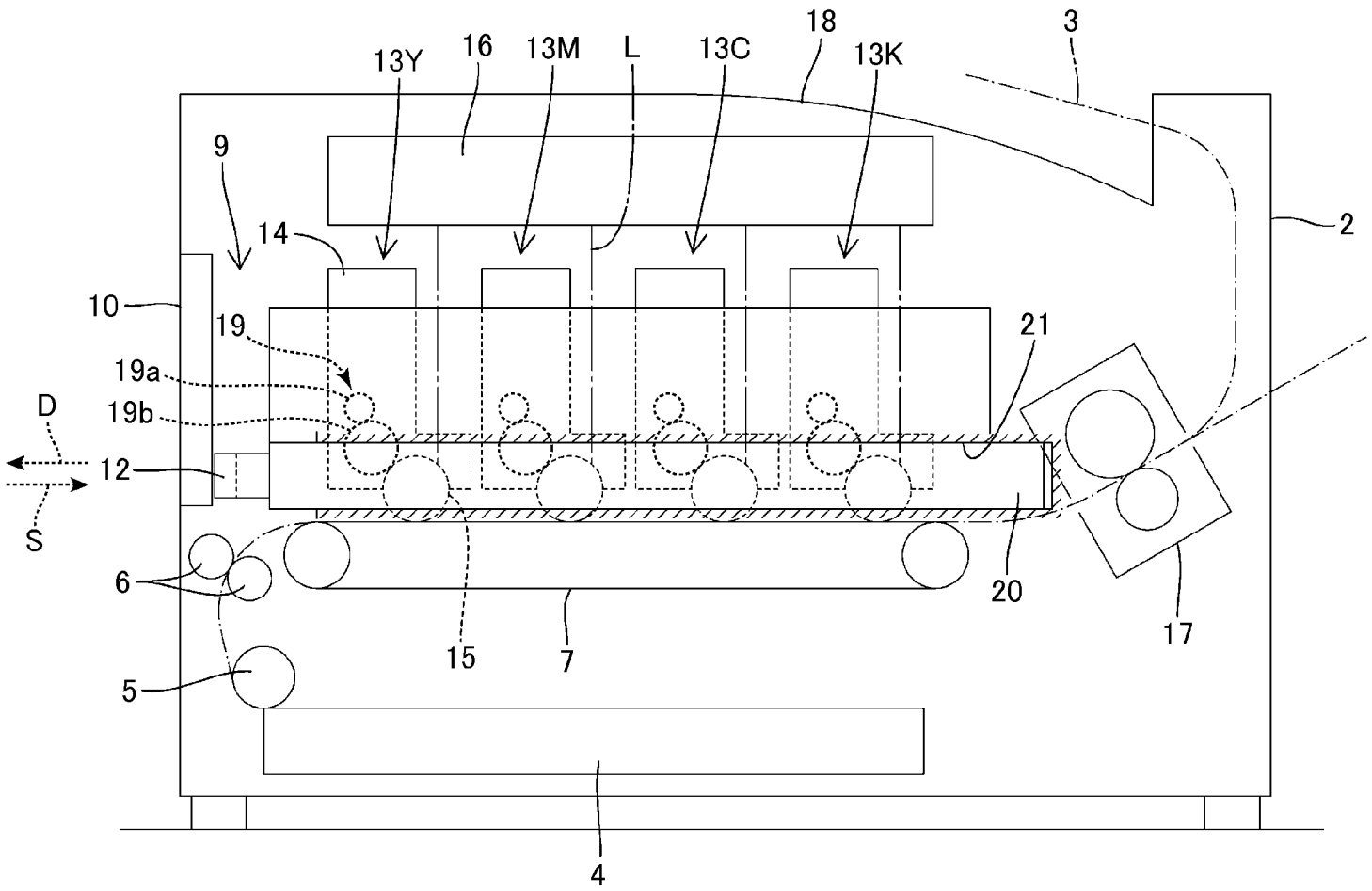
FIG. 11 is a schematic side sectional view of a laser printer in accordance with a second embodiment.
Figure 12:
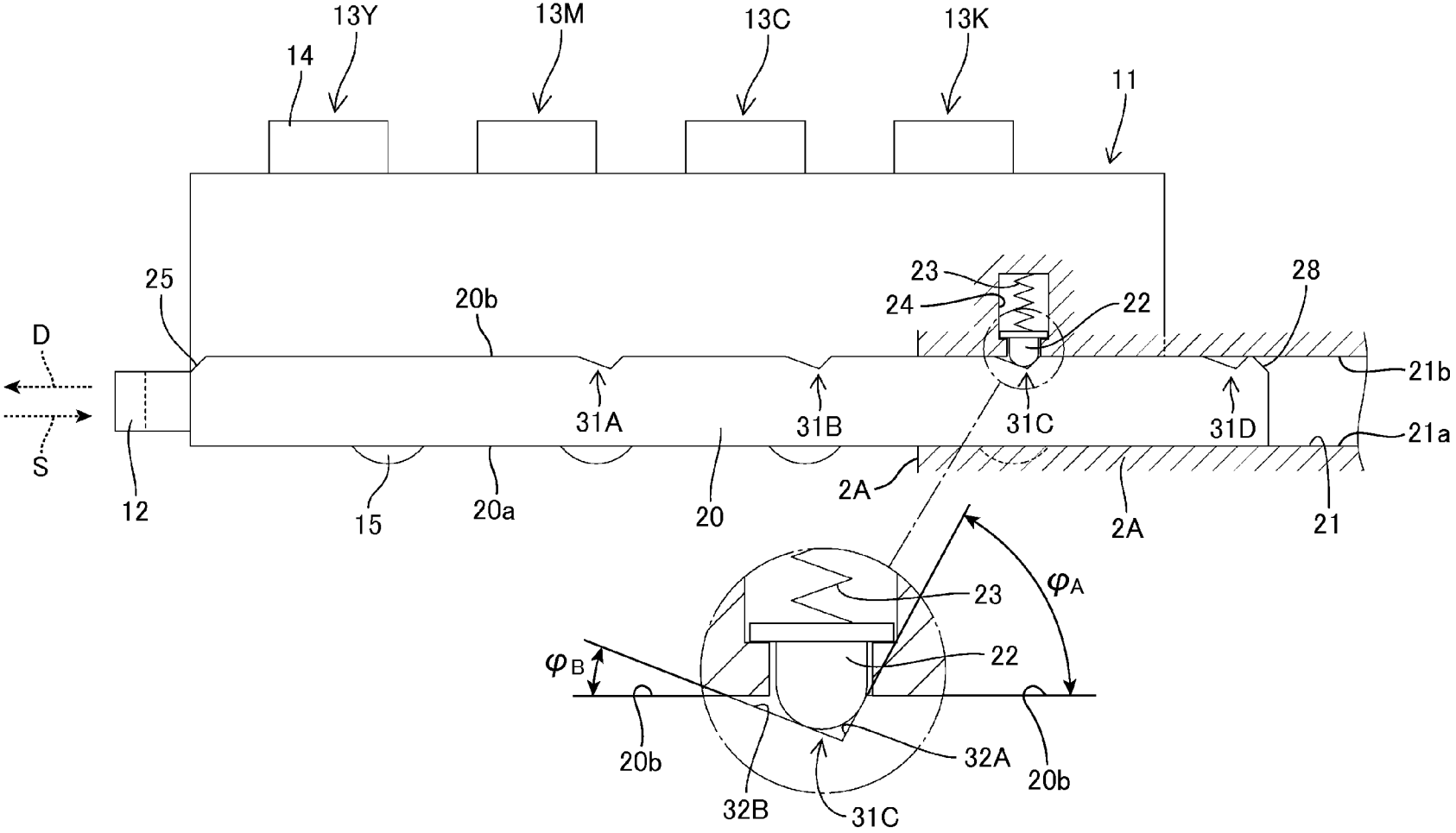
FIG. 12 is a schematic side sectional view of the drawer and guide groove in a state where the drawer is located at the third drawing position according to the second embodiment.

FIG. 11 is a schematic side sectional view of the laser printer 30, and FIG. 12 is a schematic side sectional view of the drawer 11 and guide groove 21 in the state where the drawer 11 is drawn out to the third drawing position.

In the laser printer 30 of this embodiment, the guide groove 21 extends in the horizontal direction, and therefore the drawer 11 is drawn out in the horizontal direction with respect to the main body casing 2. In other words, according to the present embodiment, the drawing direction D and the storing direction S are defined along the horizontal.

As shown in FIG. 12, the guide protrusion 20 of the present embodiment is formed with four engagement recesses 31A to 31D in place of the four engagement recesses 26A to 26D in the first embodiment. Each engagement recess 31A, 31B, 31C, or 31D has a rear-side inclined surface 32A and a front-side inclined surface 32B. A slope of the rear-side inclined surface 32A relative to the top surface 20*b* is larger than a slope of the front-side inclined surface 32B relative to the top surface 20*b*. More specifically, an angle $\phi A$ (greater than zero degree) defined between the rear-side inclined surface 32A and the top surface 20*b* is greater than an angle $\phi B$ (greater than zero degree) defined between the front-side inclined surface 32B and the top surface 20*b*.

In the state where the engaging member 22 is in engagement with one of the engagement recesses 31A to 31D, when the user presses or pushes the drawer 11 in the storing direction S, the engagement between the engaging member 22 and the engagement recess 31A, 31B, 31C, or 31D exhibits a first type of engaging force against the user's action of pushing the drawer 11 in the storing direction S. Similarly, in the state where the engaging member 22 is in engagement with one of the engagement recesses 31A to 31D, when the user pulls or draws the drawer 11 in the drawing direction D, the engagement between the engaging member 22 and the engagement recess 31A, 31B, 31C, or 31D exhibits a second type of engaging force against the user's action of drawing the drawer 11 in the drawing direction D. Because the angle $\phi A$ is greater than the angle $\phi B$, the amount of the first type of engaging force against the user's pushing action is smaller than the amount of the second type of engaging force against the user's drawing action. Thus, an operating force required for disengaging the engaging member 22 from the engagement recess 31A, 31B, 31C, or 31D by pushing the drawer 11 to the storage position is smaller than an operating force required for disengaging the engaging member 22 from the engagement recess 31A, 31B, 31C, or 31D by drawing the drawer 11 in the drawing direction D. Therefore, the drawer 11 can be moved with a smaller force during the pressing than during the drawing, resulting in improvement in operability.

While the invention has been described in detail with reference to the above-described embodiments thereof, it would be apparent to those skilled in the art that various changes and modifications may be made therein without departing from the spirit of the invention.

In the above description, each process cartridge 13 can be detached from the drawer 11. However, each process cartridge 13 may be fixed to the drawer 11 and may not be detached from the drawer 11.

In the above description, the entire part of each process cartridge 13 can be detached from the drawer 11. However, only a part of the process cartridge 13 may be detached from the drawer 11. For example, only a part of the process cartridge 13 that includes the toner case 14 may be detached from the drawer 11. Only the toner caser 14 may be detached from the drawer 11.

In the above description, the engaging member 22 is engaged to and disengaged from the engagement recesses 26A to 26D or the engagement recesses 31A to 31D in association with the drawing or pushing action of the drawer 11. However, engagement and disengagement of the engaging member 22 to and from the engagement recesses 26A to 26D or the engagement recesses 31A to 31D may be carried out by a separate operation other than the movement of the drawer 11. For example, an operating part for operating the engaging member 22 may be provided on the drawer 11 side or on the main body 2 side. The user can move the drawer 11 while operating the operating part to maintain the engaging member 22 at the release position.

In the above description, the engaging member 22 is provided on the main body casing 2 side, and the engagement recesses 26A to 26D or the engagement recesses 31A to 31D are provided on the drawer 11 side. However, the engaging member 22 may be provided on the drawer 11 side, and the engagement recesses 26A to 26D or the engagement recesses 31A to 31D may be provided on the main body casing 2 side.

In the above description, the bore 24 extends perpendicularly to the predetermined drawing direction D. However, the bore 24 may not extend perpendicularly to the predetermined drawing direction D as long as the bore 24 extends in a direction intersecting with the predetermined drawing direction D. In this case, the engaging member 22 and coil spring 23 are provided in the bore 24 so that the coil spring 23 urges the engaging member 22 along the longitudinal axis of the bore 24, that is, in the direction intersecting the drawing direction D.

The engaging force F1 may be smaller than the value of $\{mg(\sin \theta 0)\}/(\tan \theta B)$ when there is some amount of friction between the bottom surface 20*a* of the guide protrusion 20 and the floor surface 21*a* of the guide groove 21.

What is claimed is:

1. An image forming device comprising:

a main body having an opening and a guide groove;

a drawer having a first engaging portion, the drawer comprising:

a guide protrusion configured to guide the drawer in a predetermined drawing direction along the guide groove, the guide protrusion including:

a second engaging portion;

a third engaging portion;

a fourth engaging portion; and a fifth engaging portion, a first image forming unit a second image forming unit, a third image forming unit, and a fourth image forming unit, wherein the first, second, third and fourth image forming units are aligned in the drawer in the predetermined drawing direction; and an engagement mechanism comprising:

an engaging member engageable with the first engaging portion, and an urging member urging the engaging member;

wherein the drawer is movable through the opening in the predetermined drawing direction from a storage position where the first image forming unit is stored inside the main body to an exposed position where the first image forming unit is exposed outside of the main body, wherein the engaging member engages with the first engaging portion when the drawer is in the storage position, and wherein the engaging member does not engage with the first engaging portion when the drawer is in the exposed position, wherein the engagement mechanism is engaged with the second engaging portion if the drawer reaches a first drawing position where the first image forming unit is exposed outside of the main body, wherein the engagement mechanism is engaged with the third engaging portion if the drawer reaches a second drawing position where the second image forming unit is exposed outside of the main body, wherein the engagement mechanism is engaged with the fourth engaging portion if the drawer reaches a third drawing position where the third image forming unit is exposed outside of the main body, and wherein the engagement mechanism is engaged with the fifth engaging portion if the drawer reaches a fourth drawing position where the fourth image forming unit is exposed outside of the main body.

2. An image forming device comprising:

a main body having an opening and a guide groove;

a drawer having an engaging portion, the drawer comprising:

a guide protrusion configured to guide the drawer in a predetermined drawing direction along the guide groove, and a first image forming unit;

an engagement mechanism comprising:

an engaging member movable between a retracted position and a protruded position; and an urging member urging the engaging member from the retracted position toward the protruded position, wherein the drawer is movable through the opening in the predetermined drawing direction from a storage position where the first image forming unit is stored inside the main body to an exposed position where the first image forming unit is exposed outside of the main body, and wherein the engaging member protrudes toward the engaging portion when the drawer is in the storage position.

3. The image forming device according to claim 2, wherein the drawer further comprises:

a second image forming unit;

a third image forming unit; and a fourth image forming unit, and wherein the first, second, third and fourth image forming units are aligned in the drawer in the predetermined drawing direction.

4. The image forming device according to claim 3, wherein the guide protrusion of the drawer further comprises:

a first engaging recess;

a second engaging recess;

a third engaging recess; and a fourth engaging recess, wherein the engagement member protrudes into the first engaging recess if the drawer reaches a first drawing position where the first image forming unit is exposed outside of the main body, wherein the engagement member protrudes into the second engaging recess if the drawer reaches a second drawing position where the second image forming unit is exposed outside of the main body, wherein the engagement member protrudes into the third engaging recess if the drawer reaches a third drawing position where the third image forming unit is exposed outside of the main body, and wherein the engagement member protrudes into the fourth engaging recess if the drawer reaches a fourth drawing position where the fourth image forming unit is exposed outside of the main body.

* * * * *